US008240985B2

(12) United States Patent
Martin

(10) Patent No.: US 8,240,985 B2
(45) Date of Patent: Aug. 14, 2012

(54) SHROUD SEGMENT ARRANGEMENT FOR GAS TURBINE ENGINES

(75) Inventor: Yves Martin, Boucherville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1142 days.

(21) Appl. No.: 12/111,223

(22) Filed: Apr. 29, 2008

(65) Prior Publication Data

US 2009/0269188 A1 Oct. 29, 2009

(51) Int. Cl.
*F01D 9/00* (2006.01)

(52) U.S. Cl. ..... 415/173.1; 415/1; 415/139

(58) Field of Classification Search ..... 415/173.1, 415/139, 1; 277/647
See application file for complete search history.

(56) References Cited

U.S. PATENT DOCUMENTS

| | | | | |
|---|---|---|---|---|
| 3,323,708 | A * | 6/1967 | Nesbit | 229/72 |
| 3,529,906 | A * | 9/1970 | McLaurin | 415/116 |
| 4,029,436 | A | 6/1977 | Shoup, Jr. et al. | |
| 4,477,086 | A | 10/1984 | Feder et al. | |
| 4,524,980 | A | 6/1985 | Lillibridge et al. | |
| 4,749,333 | A | 6/1988 | Bonner et al. | |
| 4,767,260 | A | 8/1988 | Clevenger et al. | |
| 4,902,198 | A | 2/1990 | North | |
| 5,158,430 | A | 10/1992 | Dixon et al. | |
| 5,167,485 | A | 12/1992 | Starkweather | |
| 5,531,457 | A | 7/1996 | Tibbott et al. | |
| 5,624,227 | A | 4/1997 | Farrell | |
| 5,709,530 | A | 1/1998 | Cahill et al. | |
| 5,762,472 | A * | 6/1998 | Pizzi et al. | 415/135 |
| 5,868,398 | A | 2/1999 | Maier et al. | |
| 5,927,942 | A | 7/1999 | Stahl et al. | |
| 5,971,703 | A * | 10/1999 | Bouchard | 415/135 |
| 5,997,247 | A | 12/1999 | Arraitz et al. | |
| 6,162,014 | A | 12/2000 | Bagepalli et al. | |
| 6,883,807 | B2 | 4/2005 | Smed | |
| 7,201,559 | B2 | 4/2007 | Gendraud et al. | |
| 7,217,081 | B2 * | 5/2007 | Scheurlen et al. | 415/1 |
| 7,217,089 | B2 | 5/2007 | Durocher et al. | |
| 7,341,256 | B2 * | 3/2008 | Nakaoka et al. | 277/496 |
| 2006/0082074 | A1 | 4/2006 | Synnott et al. | |
| 2007/0020087 | A1 | 1/2007 | Durocher et al. | |

FOREIGN PATENT DOCUMENTS

| | | |
|---|---|---|
| JP | 2006-220047 | 8/2006 |

* cited by examiner

*Primary Examiner* — Ninh H Nguyen
(74) *Attorney, Agent, or Firm* — Norton Rose Canada LLP

(57) ABSTRACT

The gas turbine engine shroud comprises a plurality of circumferentially-disposed and concentric shroud segments. Each shroud segment has an arc-shaped platform with opposite ends, each end comprising an inter-segment seal slot, at least one slot extending substantially across each corresponding end and having a lengthwise-variable depth.

17 Claims, 6 Drawing Sheets

SHROUD SEGMENT ARRANGEMENT FOR GAS TURBINE ENGINES

TECHNICAL FIELD

The technical field generally relates to gas turbine engines and more particularly to a shroud segment arrangement.

BACKGROUND

Gas turbine engines often include a plurality of side-by-side shroud segments disposed circumferentially so as to form a circular shroud encircling the blades of a turbine or compressor rotor. Rectangular inter-segments seals are set in slots that are provided at the abutting ends of adjacent shroud segments so as to minimize leakage of the pressurized gases from the main gas path passing inside the shroud. These seals are also called feather seals or strip seals. The axially-extending slots for the inter-segments seals represent a discontinuity in the thermal conduction path at the ends of the shroud segments, with the inner side of the shroud segments somewhat remote from the cooling effect of the cooling air blown on the outer surface. This may adversely affect shroud segment durability at the ends of the shroud segments, particularly where the temperature of the gases in the main gas path is the hottest.

SUMMARY

In one aspect, the present concept provides a gas turbine engine shroud segment comprising an arc-shaped platform with opposite ends, a leading edge side and a trailing edge side, each end having defined therein an elongated inter-segment seal slot, said slot extending substantially across each corresponding end from a position adjacent the leading edge side to a position adjacent the trailing edge side, at least one of said slots having a lengthwise-variable depth, said depth being a minimum at the leading edge side and a maximum at the trailing edge side.

In another aspect, the present concept provides an air-cooled shroud for a gas turbine engine, the shroud comprising a plurality of circumferentially-disposed shroud segments between which are provided inter-segment seals, each shroud segment being concentric with reference to a longitudinal axis and having opposite ends, and an inner side and an outer side with reference to a main hot gas path of the gas turbine engine, each end of each shroud segment including at least one axially-extending slot adjacent to the inner side, the slot receiving a corresponding one of the seals and having a depth that is shallower at a high temperature section compared to the depth of the same slot at a low temperature section, the high and low temperature sections being axially opposite one another.

In another aspect, the present concept provides an inter-segment seal for shroud segments in a gas turbine engine, the inter-segment seal comprising elongated opposite first and second ends and two opposite sides, the seal having a width between its opposite sides that is smaller at the first end than at the second end. In another aspect, the present concept provides a method of cooling a shroud in a gas turbine engine, the shroud having a plurality of shroud segments including an inter-segment seal between each two adjacent shroud segments, the method comprising: circulating cooling air on an outer side of the shroud segments during operation of the gas turbine engine; and at each end of each shroud segment, locally increasing heat transfer between a hottest area on an inner side of the shroud segment and the cooled outer side by providing an inter-segment seal slot with an average depth in a portion of the slot that is adjacent to the hottest area being smaller than an overall average depth of the inter-segment seal slot.

Further details of these and other aspects of the improvements presented herein will be apparent from the following detailed description and appended figures.

DETAILED DESCRIPTION

Figure 1:
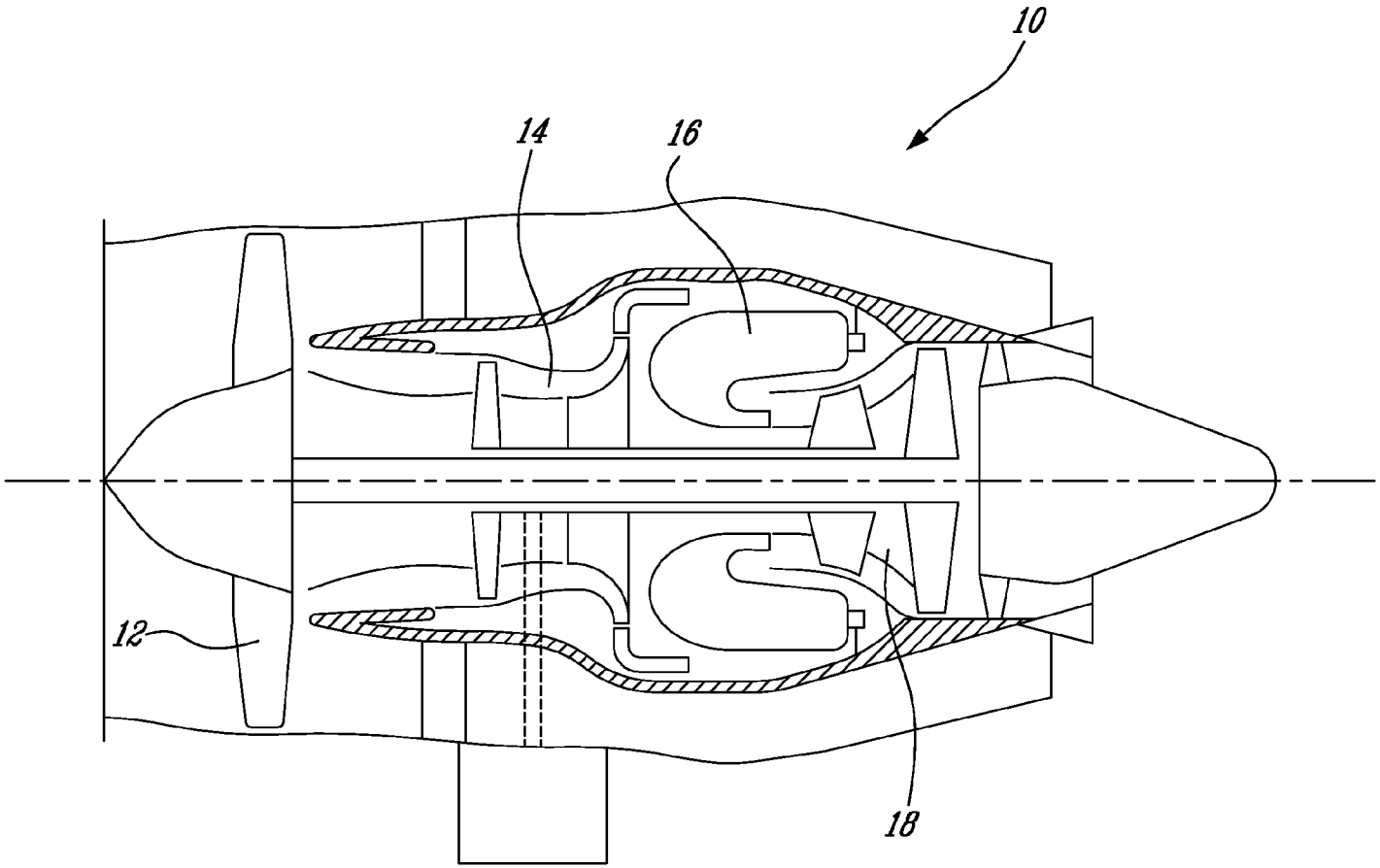
FIG. 1 schematically shows a generic gas turbine engine to illustrate an example of a general environment in which the shroud segment cooling arrangement can be used.

FIG. 1 illustrates an example of a gas turbine engine 10 generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. This figure only illustrates one among many possible examples of an environment in which the shroud segment cooling arrangement can be used.

Figure 2:
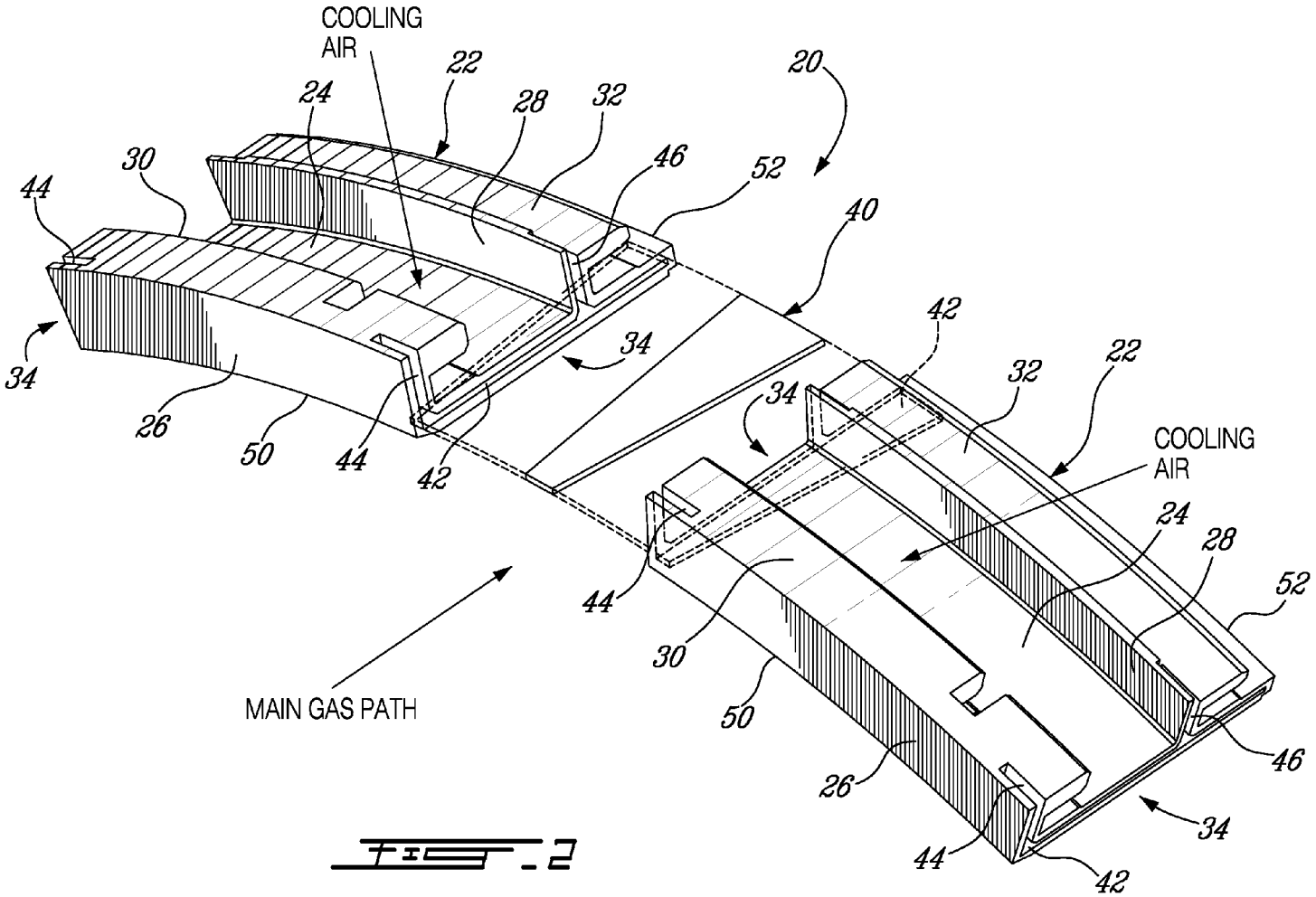
FIG. 2 is an isometric exploded view showing an example of two shroud segments and an example of an inter-segment seal.

FIG. 2 is an isometric exploded view showing a portion of an example of a shroud 20 as improved. The shroud 20 includes a plurality of shroud segments 22. Only two of these shroud segments 22 are shown in FIG. 2 and they are shown as they would appear before assembly. The shroud segments 22 is this example are identical. They are arranged circumferentially and concentric with a longitudinal axis, which axis corresponds to the rotation axis of the rotor around which the shroud 20 is mounted.

Each illustrated shroud segment 22 includes a platform 24 that is substantially an arc-shaped member having a pair of spaced-apart upstanding ribs 26, 28, each having flanges 30, 32, respectively. The ribs 26, 28 and respective flanges 30, 32 act to support the platform 24 and can also define cooling air passages and chambers. The flanges 30, 32 can also serve to mount the shroud 20 within the engine casing. Opposite ends of the platform 24 of the shroud segments 22 are identified with reference numeral 34.

Being exposed to very hot gases from the main gas path circulating through the compressor 14 or the turbine section 18 of the engine 10, the shroud 20 may need to be cooled using cooling air blown on its outer side, as schematically illustrated in FIG. 2. Cooling air is provided using any suitable arrangement. Such arrangements are well known in the industry and need not be discussed further.

FIG. 2 also illustrates an example of an inter-segment seal 40 for use between the two adjacent shroud segments 22 of the improved shroud 20. Each shroud segment 22 includes an elongated and axially-extending slot 42 for receiving a corresponding half of the seal 40. The seal slot 42 extends substantially across the entire corresponding end 34. Other slots 44, 46 are also provided in the illustrated shroud segments 22 for receiving one or more additional inter-segment seals (not shown) configured and disposed to fit within these slots 44, 46. Inter-segment seals minimize leakage of the hot gases from the main gas path between adjacent shroud segments 22 during the operation of the engine 10.

Figure 3:
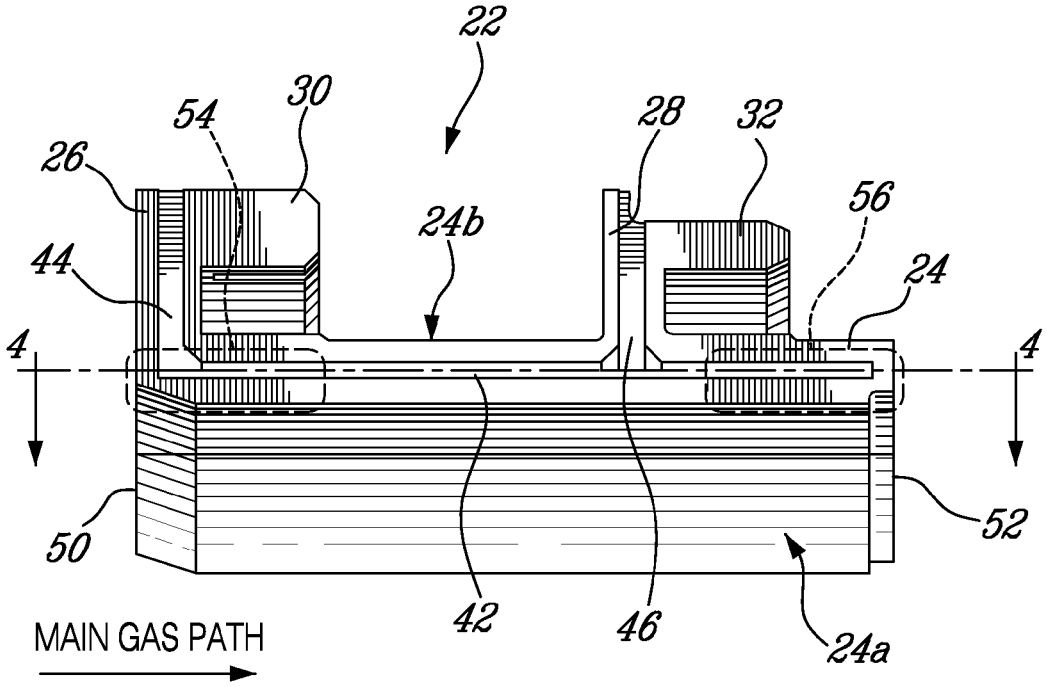
FIG. 3 is an end view of one of the shroud segments shown in FIG. 2.

FIG. 3 shows one end 34 of the shroud segment 22 that is at the left in FIG. 2. The abutting end 34 on the other shroud segment 22 in FIG. 2 would appear as a mirror image of what is shown in FIG. 3. FIG. 3 also shows the inner side 24*a* and the outer side 24*b* of the platform 24 of the shroud segment 22.

Figure 4:
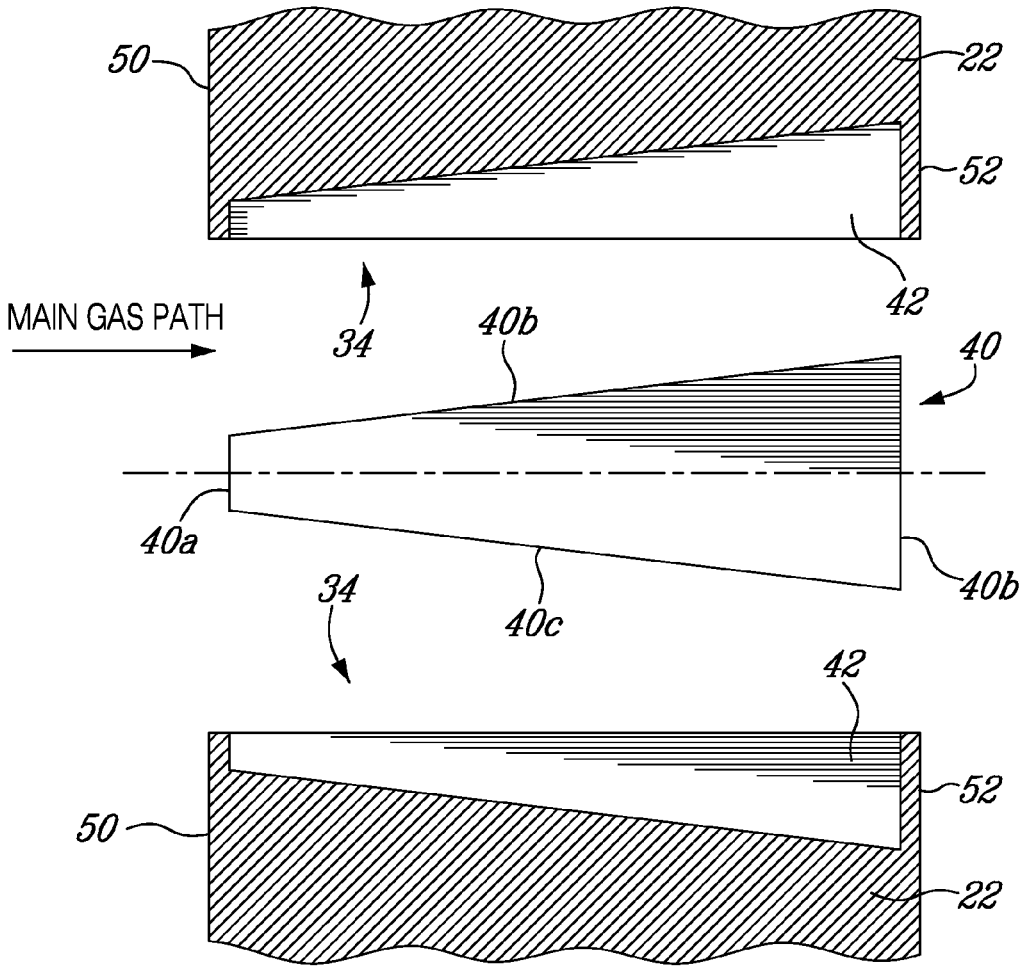
FIG. 4 is a cross-sectional view showing the two shroud segments of FIG. 2, which cross section is taken according to line 4-4 in FIG. 3, and also showing the inter-segment seal of FIG. 2 as viewed from a radially outer side.

FIG. 4 is a cross-sectional view showing the ends 34 of the shroud segments 22 in FIG. 2. The cross section corresponds to line 4-4 in FIG. 3. Like in FIG. 2, the shroud segments 22 are shown before assembly. The inter-segment seal 40 illustrated in FIG. 2 is also shown in FIG. 4, as viewed from a radially outer side.

It should be noted that the shroud segments 22 illustrated in FIGS. 2 to 4 are for use around the turbine stage of a gas turbine engine, such as one of the turbine stages in the turbine section 18 of the engine 10 (FIG. 1). The main gas path is depicted by an arrow. The shroud segment cooling arrangement can also be used in a shroud around a compressor stage. The main gas path would then be in the opposite direction with reference to the enclosed figures.

The upstream side of the shroud segments 22 is identified with reference numeral 50 and the downstream side is identified with reference numeral 52. The "upstream" and "downstream" directions are relative to the main gas path. During the operation of the engine, and since the illustrated example is for a turbine shroud, the hottest temperatures on the inner side 24*a* of the shroud segments 22 are present in a high temperature section adjacent to the upstream side 50. This high temperature section is depicted in FIG. 3, using reference numeral 54, so as to generally show where is located. The downstream side 52 is adjacent to a low temperature section, which low temperature section is depicted using reference numeral 56 in FIG. 3. The "high" and "low" adjectives are relative to each other and do not refer to particular temperature values. The size of the axially-opposite sections 54, 56 is only approximative.

Because the slots 42 for the inter-segment seals 40 represent a discontinuity in the thermal conduction cooling path, portions of the shroud segments 22 adjacent to the inner side 24*a* and located in the high temperature section 54—which portions are immediately under the axial slots 42—are somewhat remote from the cooling effect of the cooling air on the outer side 24*b*. To mitigate deficiencies in the cooling, the slot 42 of each shroud segment 22 has a depth that is shallower in the high temperature section 54 compared to the depth of the same slot 42 in the low temperature section 56. This way, the hottest portions at the ends of the shroud segments 22 can have an improved cooling and the inter-segments seals 40 still have slots 42 that are deep enough to retain them.

As can be seen in FIG. 4, the depth of the slots 42 of each shroud segment 22 varies along its length and the corresponding inter-segment seal 40 also has a width varying along its length, as explained hereafter. The minimum depth of the slot 42 is at its end that is in the high temperature section 54 and the maximum depth of the slot 42 is at its end that is in the low temperature section 56. This design provides an improved cooling at the ends 34 of the shroud segments 22 where the hottest temperatures are expected during the operation of the engine 10.

As aforesaid, FIG. 4 also shows the inter-segment seal 40 shown in FIG. 2. The elongated inter-segment seal 40 comprises opposite first and second ends 40*a*, 40*b*, and two opposite sides 40*c*, 40*d*. The seal 40 has an axis of symmetry longitudinally extending between the first end 40*a* and the second end 40*b*. The seal 40 has a width between its opposite sides 40*c*, 40*d* that is smaller at the first end 40*a* than at the second end 40*b*, forming a trapezoidal or wedge-shaped seal. The shape of each half of the illustrated seal 40 substantially corresponds to the shape of the corresponding illustrated slots 42. The seal 40 also has continuous surfaces on its opposite sides 40*c*, 40*d*.

In use, during operation of the engine 10, cooling air is circulated on the outer side 24*b* of the shroud segments 22, as schematically depicted in FIG. 2. At each end 34 of each shroud segment 22, heat transfer is locally increased between the hottest area 54 on an inner side of the shroud segments 22 and the cooled outer side 24*b* since a portion of the inter-segment seal slot 42 that is adjacent to the hottest area 54 is provided with a smaller average depth than an overall average depth of the inter-segment seal slot 42, i.e. the average depth along the entire slot 42. This configuration improves the local heat conduction, thus the cooling, while still providing a good retention of the seal 40. The improved cooling can improve the shroud segment durability because of the lower temperatures.

Figure 5:
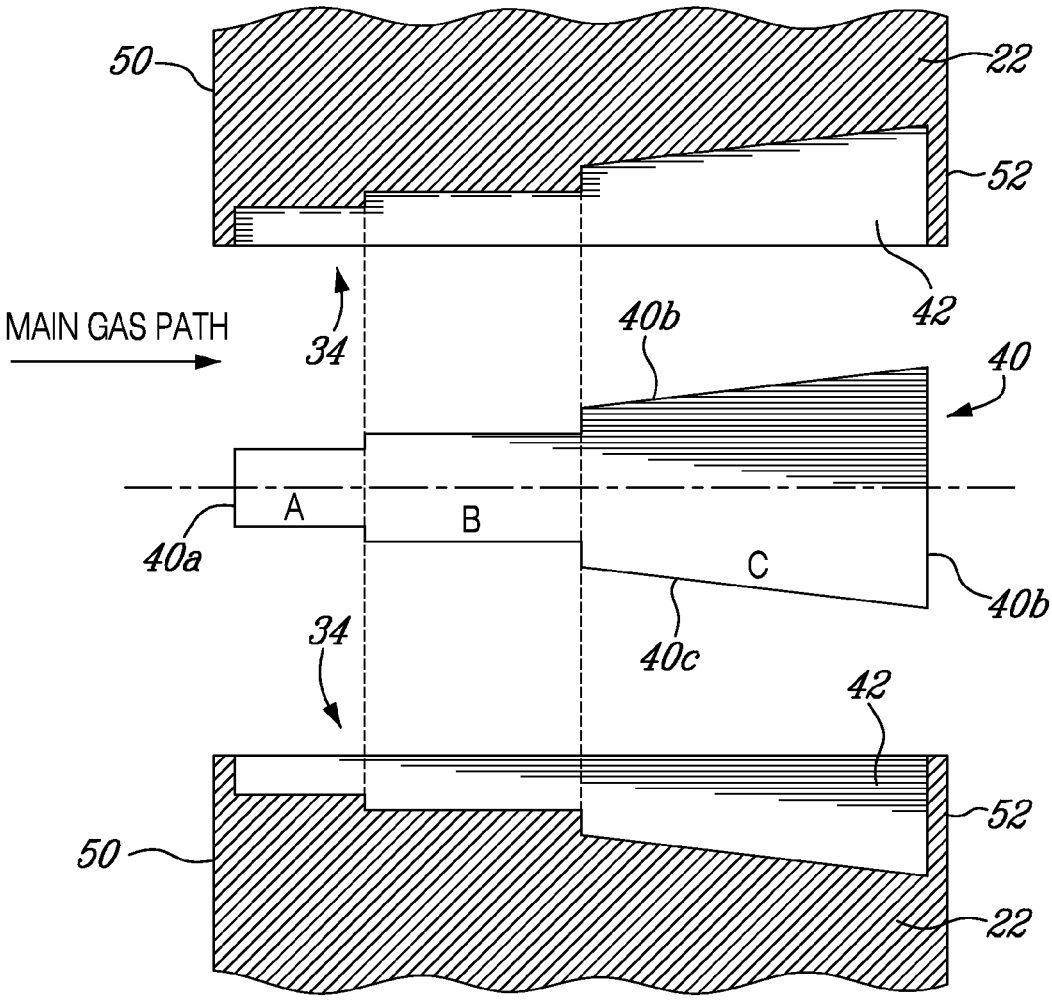
FIG. 5 is a view similar to FIG. 4, showing another example.
Figure 6:
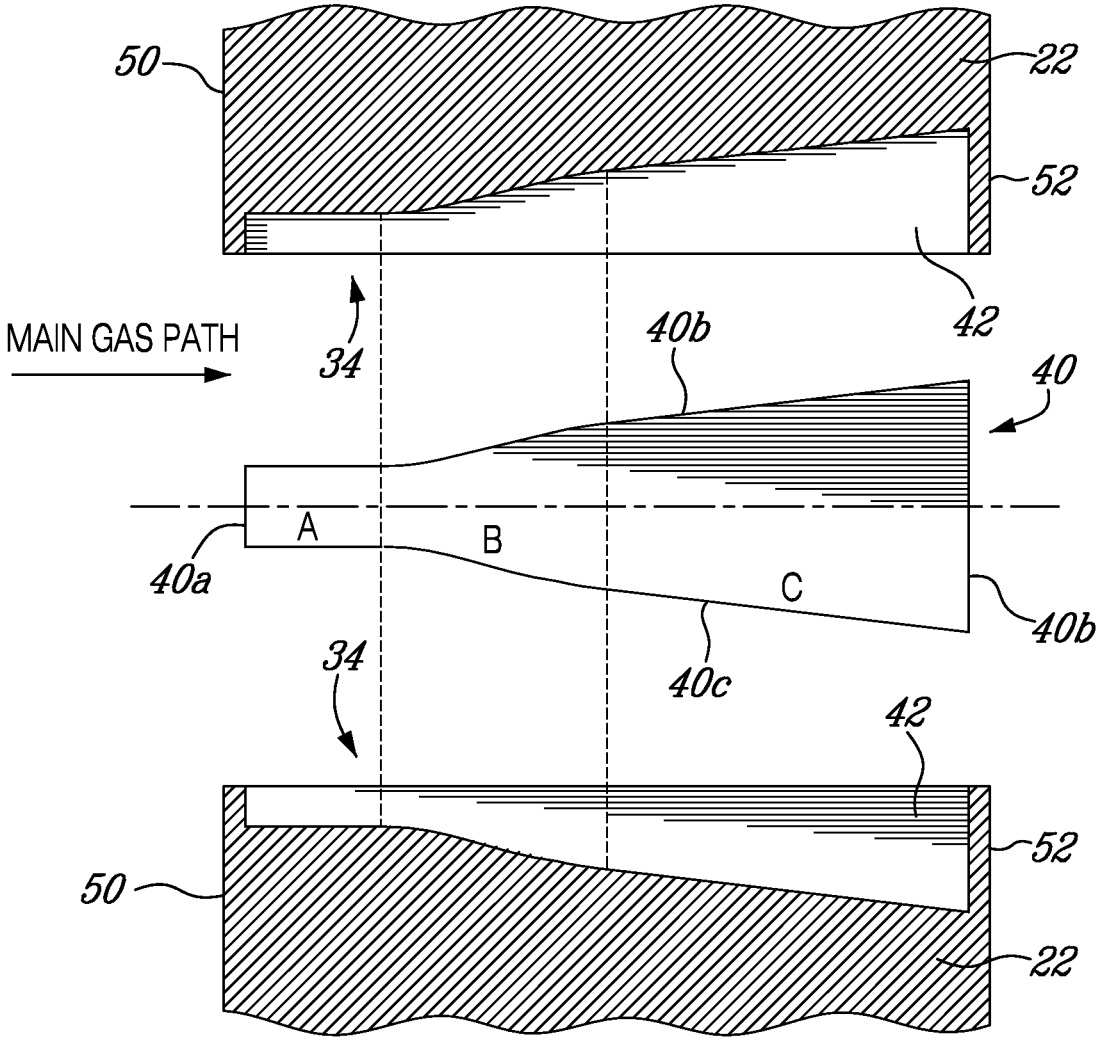
FIG. 6 is a view similar to FIG. 4, showing another example.

The depth of the slot 42 is illustrated herein as being constantly varying along its length. However, a lengthwise-variable depth can also be provided using other configurations. One can provide, for example, a step-shaped slot with a discontinuous depth change, the slot having for instance a first constant depth in a first slot section ("A"), a second constant depth in a second slot section ("B") and a third constant depth in a third slot section ("C") as shown in FIG. 5, the slot section "A" having the hottest temperatures being the shallowest. The slot sections may be more than three in number and need not necessarily having a constant depth or a constantly varying depth. As shown in FIG. 6, a combination of continuous and discontinuous depth/width changes may also be employed, such as a first constant depth/width step ("A"), followed by an ever increasing continuous depth/width change ("B"), followed by another constant depth/width step ("C"). As seen in FIG. 6, the second portion "B", which has an ever-increasing width/depth, may have a non-linear (e.g. parabolic) profile, or any other suitable profile depending on the performance characteristics desired.

Furthermore, although the illustrated seal 40 has a shape substantially corresponding to that of the slot 42, one can provide seals 40 with opposite sides 40*c*, 40*d* that are not exactly matching the shape or shapes at the bottom of the slots 42. It may be possible to provide more than one inter-segment seal 40 into a same slot 42, or have a seal 40 (or more than one seal 40) that is shaped with radial walls fitting into one or more of the additional slots 44, 46.

Overall, the above description is meant to be exemplary only, and one skilled in the art will recognize that changes may be made to what is described while still remaining within the same concept. For instance, the shapes of the shroud segments can be different from what is illustrated in the figures. Shroud segments need not necessarily be identical around the circumference of the shroud. The slots on the abutting ends of the adjacent shroud segments can be different from one another and therefore, the inter-segment seal fitting in these dissimilar slots can have asymmetric halves.

Seals need not be symmetrical, nor have the same profile on each edge—the above-described profile may be provided, for example, on one side, with the other side having another profile, such as a square (or other suitable) edge shape. Still other modifications will be apparent to those skilled in the art, in light of a review of this disclosure, and such modifications are intended to fall within the scope of the appended claims.

What is claimed is:

1. A gas turbine engine shroud segment comprising an arc-shaped platform with opposite ends, a leading edge side and a trailing edge side, each end having defined therein an elongated inter-segment seal slot, said slot extending substantially across each corresponding end from a position adjacent the leading edge side to a position adjacent the trailing edge side, at least one of said slots having a lengthwise-variable depth, said depth being a minimum at the leading edge side and a maximum at the trailing edge side.

2. The shroud segment as defined in claim 1, wherein the depth varies continuously between the minimum and the maximum depth.

3. The shroud segment as defined in claim 2, wherein the depth varies linearly between the minimum and the maximum depth.

4. The shroud segment as defined in claim 1, wherein the depth varies discontinuously between the minimum and the maximum depth.

5. The shroud segment as defined in claim 4, wherein the depth varies in a step-wise manner between the minimum and the maximum depth.

6. The shroud segment as defined in claim 1, wherein the depth only increases between the minimum and the maximum depth.

7. The shroud segment as defined in claim 6, wherein the depth increases continuously between the minimum and the maximum depth.

8. The shroud segment as defined in claim 6, wherein the depth increases with a constant slope between the minimum and the maximum depth.

9. The shroud segment as defined in claim 6, wherein the depth increases with a changing slope between the minimum and the maximum depth.

10. The shroud segment as defined in claim 1, wherein the depth increases discontinuously between the minimum and the maximum depth.

11. An air-cooled shroud for a gas turbine engine, the shroud comprising a plurality of circumferentially-disposed shroud segments between which are provided inter-segment seals, each shroud segment being concentric with reference to a longitudinal axis and having opposite ends, and an inner side and an outer side with reference to a main hot gas path of the gas turbine engine, each end of each shroud segment including at least one axially-extending slot adjacent to the inner side, the slot receiving a corresponding one of the seals and having a depth that is shallower at a high temperature section compared to the depth of the same slot at a low temperature section, the high and low temperature sections being axially opposite one another.

12. The shroud as defined in claim 11, wherein the shroud segments are identical.

13. The shroud as defined in claim 11, wherein the depth of each slot varies continuously between the minimum and the maximum depth.

14. The shroud as defined in claim 13, wherein each inter-segment seal has a shape substantially corresponding to a shape at a bottom of each corresponding slot.

15. A method of cooling a shroud in a gas turbine engine, the shroud having a plurality of shroud segments including an inter-segment seal between each two adjacent shroud segments, the method comprising:

circulating cooling air on an outer side of the shroud segments during operation of the gas turbine engine; and at each end of each shroud segment, locally increasing heat transfer between a hottest area on an inner side of the shroud segment and the cooled outer side by providing an inter-segment seal slot with an average depth in a portion of the slot that is adjacent to the hottest area being smaller than an overall average depth of the inter-segment seal slot.

16. The method as defined in claim 15, wherein each slot has minimum depth at a first end and a maximum depth at a second end opposite the first end, the first end being in the portion adjacent to the hottest area.

17. The method as defined in claim 16, wherein the depth varies continuously between the minimum and the maximum depth.

* * * * *